US006321033B1

(12) United States Patent
Birdsell et al.

(10) Patent No.: US 6,321,033 B1
(45) Date of Patent: Nov. 20, 2001

(54) TAMPER RESISTANT ELECTRICAL ENVIRONMENTALLY CONDITIONING DEVICE

(75) Inventors: Walter Birdsell, Marlborough; John Lapetina, Newton; William J. Montague, Jr., Millis, all of MA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/550,934

(22) Filed: Apr. 17, 2000

(51) Int. Cl.[7] ..... F24H 3/00

(52) U.S. Cl. ..... 392/365; 392/360; 219/507; 200/43.11

(58) Field of Search ..... 392/365–369, 392/373, 374, 383–385, 360; 200/50.01, 43.01, 43.11, 43.13, 43.16, 43.18, 334; 34/96, 97; 219/507, 508

(56) References Cited

U.S. PATENT DOCUMENTS 3,839,614 * 10/1974 Saganowski et al. ..... 200/43.17
4,683,369 * 7/1987 Rieckman et al. ..... 392/385
5,195,164 * 3/1993 Lambert ..... 392/385

FOREIGN PATENT DOCUMENTS 8-14668 * 1/1996 (JP) .

* cited by examiner

*Primary Examiner*—John A. Jeffery

(57) ABSTRACT

A portable electric appliance including a housing defining an air inlet, an air outlet and an air flow path therebetween; a conditioner disposed in the air flow path and operable to condition air in the air flow path; a power source; and an electrical switch connected between the conditioner and the power source and having an actuator movable between an inactive position and at least one active position, the switch in its one active position transmitting power from the source to the conditioner, and in its inactive position preventing power transmission therebetween. Also included is a lock mechanism including a release element adapted for predetermined movement between a locked position and an unlocked position, the actuator and release element being shaped and arranged to require independent manipulation by, respectively, first and second body parts; and in its locked position the element prevents the given movement of the actuator, and in its unlocked position allows the given movement of the actuator.

30 Claims, 6 Drawing Sheets

TAMPER RESISTANT ELECTRICAL ENVIRONMENTALLY CONDITIONING DEVICE

BACKGROUND OF THE INVENTION

This invention relates generally to portable, environmental conditioning appliances and, more particularly, to a child-safe portable electrical heater.

Environmental conditioning devices such as heaters, humidifiers, dehumidifiers, air conditioners and air cleaners are used extensively to create comfortable environmental conditions in residential and commercial enclosures. The electrical controls of such devices are very attractive to curious children whom delight in experimental manipulation of the controls. Such activity can result in either unsafe operations or damage to the electrical controls.

Latchable controls have been proposed and employed previously to avert undesirable operation of electrical equipment. Such a control mechanism is disclosed, for example, in U.S. Pat. No. 3,994,636. However, prior latchable controls have been subject to contravention by innovative, dexterous children.

The object of this invention therefore, is to provide an improved tamper resistant environmental conditioning device.

SUMMARY OF THE INVENTION

The invention is a portable electric appliance including a housing defining an air inlet, an air outlet and an air flow path therebetween; a conditioner disposed in the air flow path and operable to condition air in the air flow path; a power source; and an electrical switch connected between the conditioner and the power source and having an actuator movable between an inactive position and at least one active position, the switch in its one active position transmitting power from the source to the conditioner, and in its inactive position preventing power transmission therebetween. Also included is a lock mechanism including a release element adapted for predetermined movement between a locked position and an unlocked position the actuator and release element being shaped and arranged to require independent manipulation by, respectively, first and second body parts; and wherein in its locked position the element prevents the given movement of the actuator, and in its unlocked position allows the given movement of the actuator. The lock mechanism can be employed to inhibit operation of the electrical switch by children.

According to one feature of the invention, the given movement is of one sense and the predetermined movement is of another sense different than the one sense. The requirement for different senses of movement inhibits contravention of the lock mechanism.

According to another feature of the invention, the actuator is a rotatable knob defining at least one notch, the release element is a push button defining a tab; and wherein in the inactive position of the actuator the tab is aligned for reciprocal movement in and out of the one notch, and in its locked position the tab is latched in the one notch, and in its unlocked position the tab is removed from the one notch. This featured structure efficiently provides the desired prevention of operation of the appliance by children.

According to a further feature of the invention, the housing defines a plurality of outer wall surfaces, the actuator projects from one surface and the element projects from a different wall surface. This structural feature complicates release of the lock mechanism to inhibit further activation of the switch by children.

According to an additional feature of the invention, the one surface is a side surface and the different surface is a top surface. The side and top surfaces are conveniently located to facilitate desired operation of the appliance.

According to yet another feature of the invention, the actuator is movable into a plurality of active positions and in each active position the switch activates the conditioner to provide a different level of conditioning to air in the air flow path. This feature provides the appliance with desired multiple modes of operation.

According to still additional features of the invention, the actuator is a rotatable knob defining a plurality of additional notches each associated with a different active position, the release element is a push button defining a tab; and wherein in each active position of the actuator, the tab is aligned for reciprocal movement in and out of the associated additional notch, and in the locked position the tab is latched in the associated notch, and in the unlocked position said tab is removed from the associated notch. This feature inhibits alteration by children of a selected operational mode of operation.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 3:
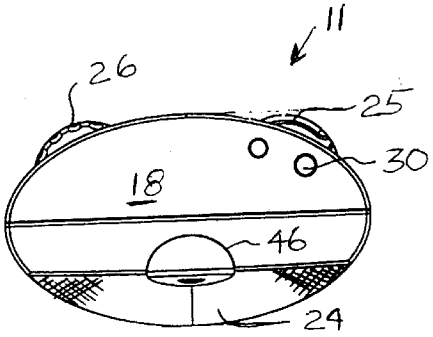
FIG. 3 is a top view of the heater shown in FIGS. 1 and 2.
Figure 2:
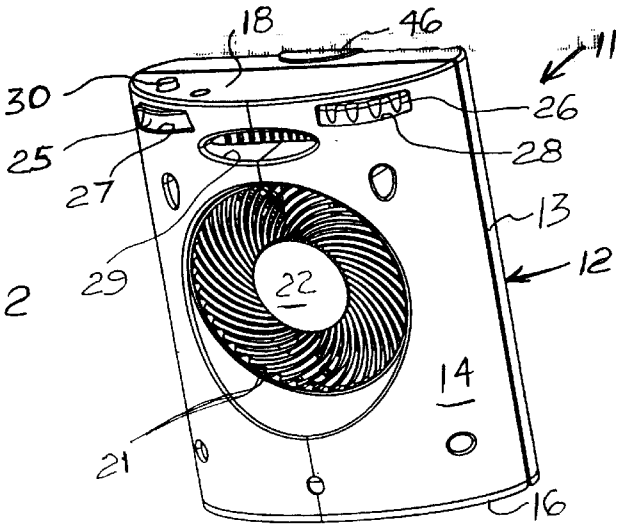
FIG. 2 is a rear perspective view of the heater shown in FIG. 1.
Figure 1:
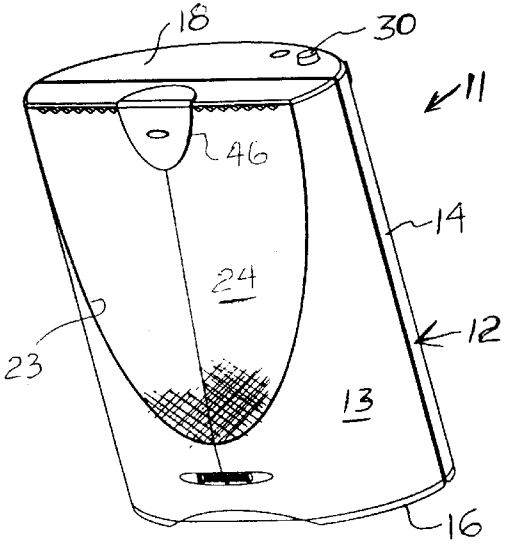
FIG. 1 is a front perspective view of a portable heater according to the invention.

An electric heater appliance 11 has a portable housing 12 formed by a semi-cylindrical front wall 13, a semi-cylindrical rear wall 14, a bottom wall 16, and a top wall 18. Defined by the rear wall 14 is an air inlet 21 covered by an inlet grill 22 while an air outlet 23 is defined by the front wall 13 and covered by an outlet grill 24. A pair of rotatable actuator knobs 25 and 26 project out of slots 27, 28, respectively, in the rear wall 14. Formed in the rear wall 14 is a recess which functions as a handle 29. A locking push button 30 projects out of an opening 20 in the top wall 18. The button 30 and actuator knobs 25 and 26 are components of an electrical control assembly 31 shown in FIGS. 4–10 and described hereinafter.

Figure 4:
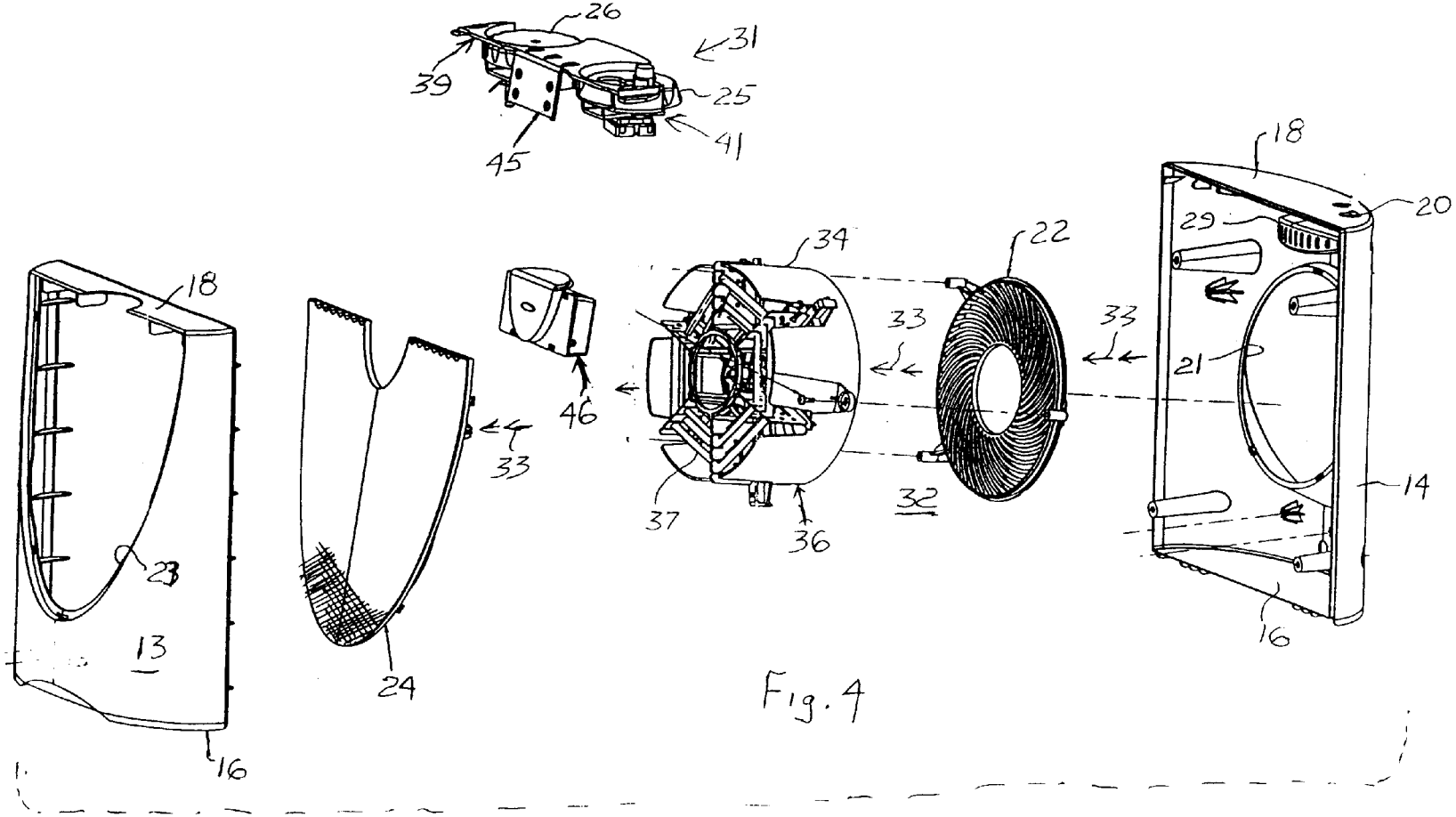
FIG. 4 is an exploded view showing certain components of the heater shown in FIGS. 1–3.
Figure 5:
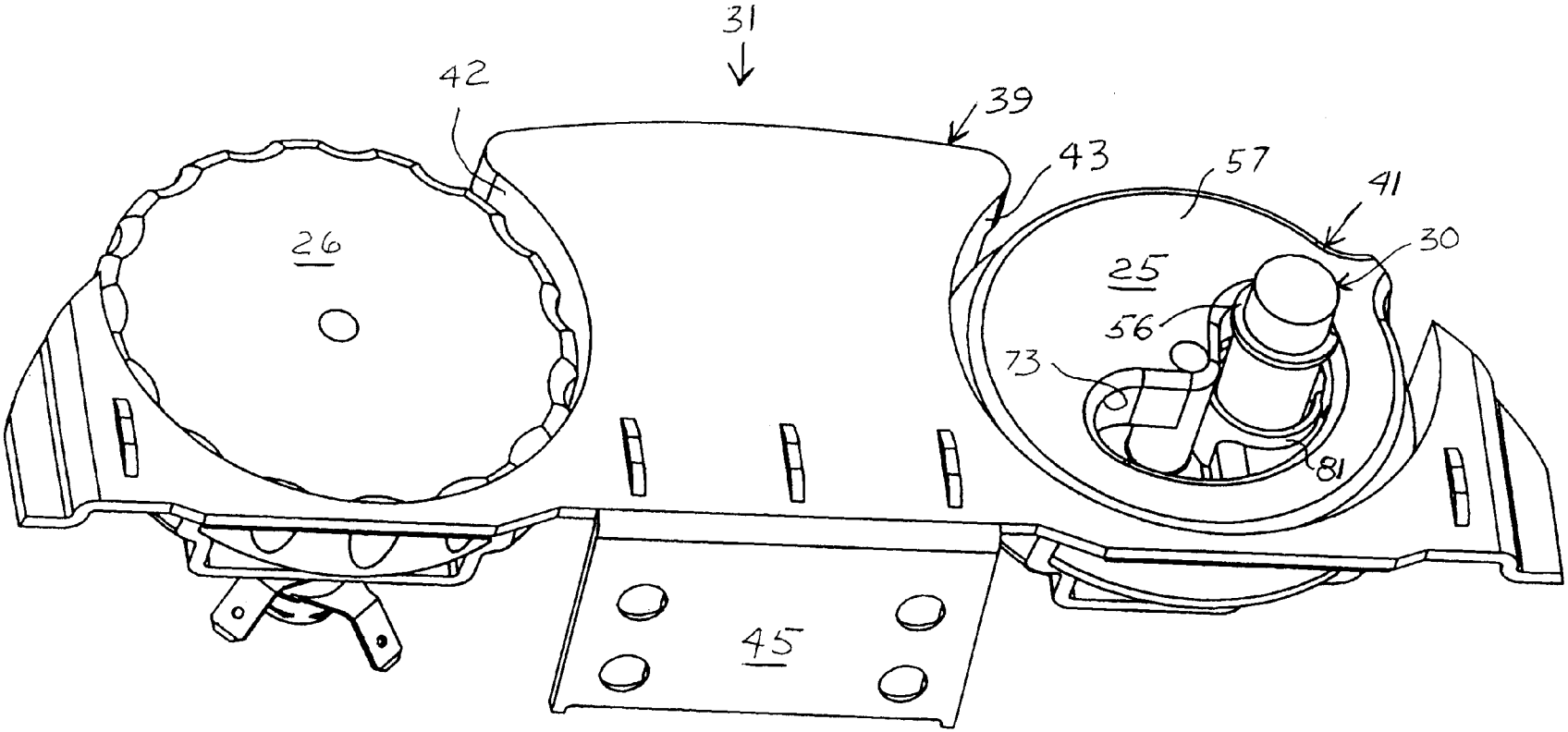
FIG. 5 is a perspective view of an electrical control assembly of the heater.

As illustrated in FIG. 4, the housing 12 defines an enclosure 32 defining an air flow path 33 extending between the air inlet 21 and the air outlet 23. The enclosure 32 encloses a shroud 34 retaining an environmental conditioner assembly 36 including a heating element 37 and fan (not shown) aligned with the air flow path 33. Structural details of the conditioner assembly 36 are disclosed in U.S. patent application Ser. Nos. 09/456,623 and 09/457,468. During use of the heater 11, the control assembly 31 is used to energize and control the conditioner assembly 36 producing, through the path 33, air flow which is heated by the heater element 37.

The control assembly 31 (FIGS. 4–6) includes a base 39 which supports the actuator knob 26 and a switch assembly 41 including the actuator knob 25 and the push-button 30. Defined by the base 39 is a semi-cylindrical recess 42 retaining the actuator knob 26 and forming and registered with the opening 28 in the rear wall 14 and a semi-cylindrical recess 43 retaining the actuator knob 25 and registered with the opening 27. A bracket 45 on the base 39 is secured to a mounting assembly 46 which in turn is secured to the top wall 18 of the housing 12. Supported by the base 39 below the recess 42 is a thermostatic control 48 having a shaft 49 keyed for rotation with the actuator knob 26.

The switch assembly 41 (FIGS. 6–10) includes a rotary electrical switch 51 mounted to a bottom wall portion 52 of the base 39 below the recess 43. Operatively connected to the rotary switch 51 by conventional circuit means (not shown) is a power source cord (not shown) and the conditioner assembly 36. Also encompassed by the switch assembly 41 is the actuator knob 25 and a locking mechanism 54 including the button 30. Defined by the button 30 is an upwardly projecting annular cavity 55 and an outwardly projecting collar 56 that moves between the top wall 18 of the housing 12 and a top surface 57. An annular compression spring 59 is retained within the annular cavity 55. Also defined at a bottom portion of the button 30 is an outwardly projecting locking tab 61.

Figure 8:
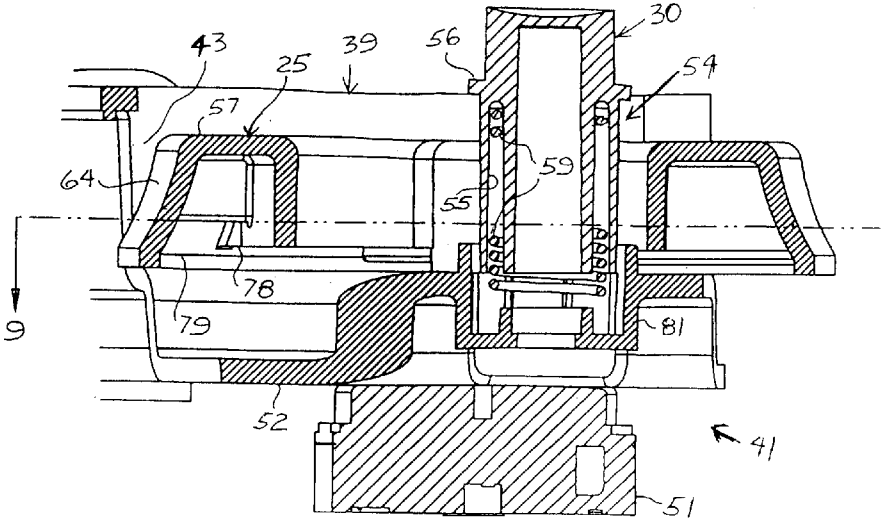
FIG. 8 is a cross-sectional view taken along lines 8—8 of FIG. 6.
Figure 6:
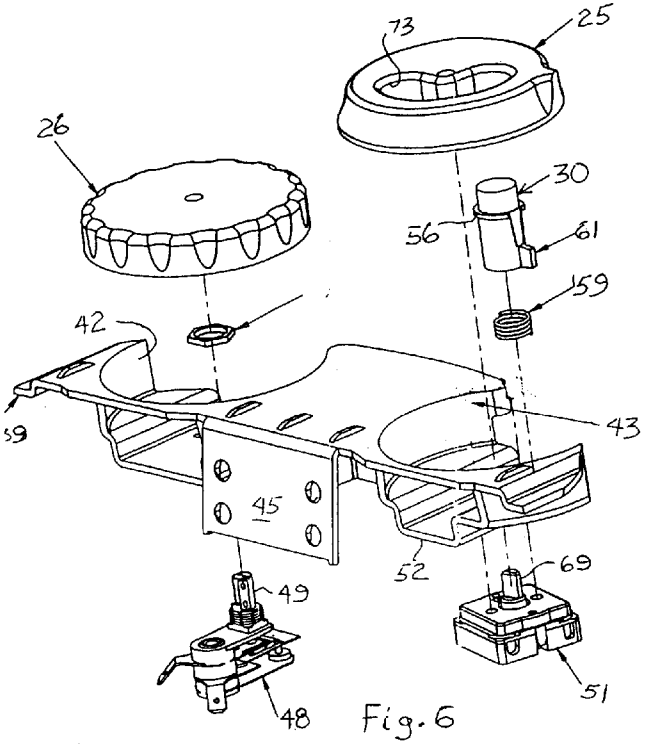
FIG. 6 is an exploded view of the electrical control assembly shown in FIG. 5.
Figure 9:
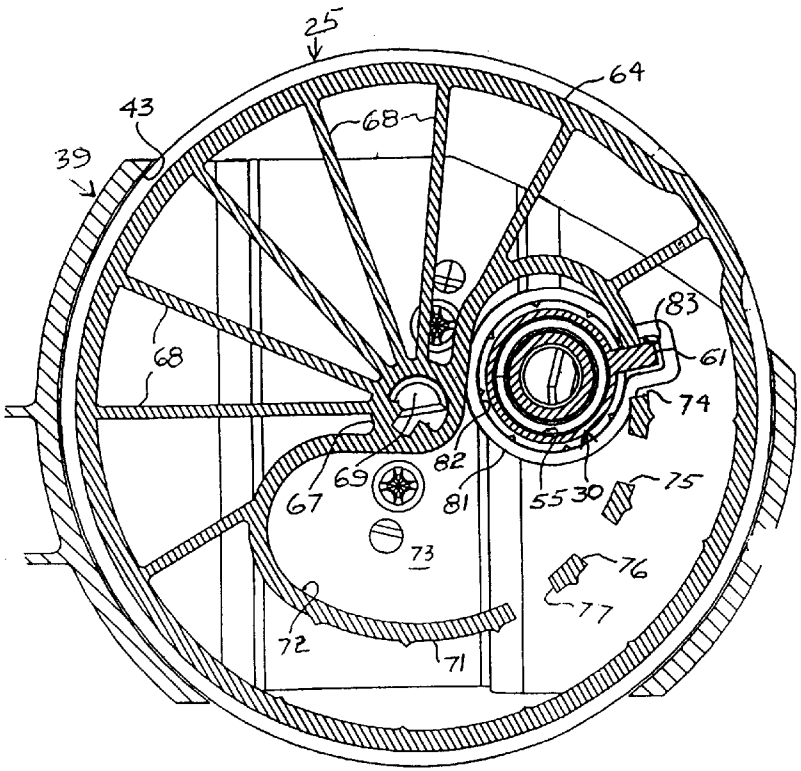
FIG. 9 is a cross-sectional view taken along lines 9—9 of FIG. 6.

The knob 25 has an inverted cup shape defined by the top wall 57 and a downwardly opening, annular side wall 64 (FIG. 9). Extending between an inner surface of the side wall 64 and a central hub 67 of the actuator 25 are a plurality of ribs 68. The hub 67 receives and is rotatably keyed to a shaft 69 of the switch 51. Also formed by the actuator knob 25 is a downwardly projecting wall portion 71 having an inner surface 72 which defines an arcuate cavity 73 extending between the top wall 63 of the knob 25 and location above the base 39. A plurality of spaced apart notches 74–77 (FIG. 9) are formed in a bottom edge 78 of the wall 71 which edge is above lower edges 79 of the ribs 68 as shown in FIG. 8.

A wall portion 81 of the base 39 projects upwardly into the actuator knob 25. Defined by the wall portion 81 is an open upper ended cylindrical cavity 82 projecting into the arcuate cavity 73 and an open upper ended, transversely rectangular cavity 83 intersecting the cylindrical cavity 82. The transverse cavity 83 is disposed below and registers vertically with forming the notches 74–77 in the wall 72 during rotation of the actuator knob 25. The compression spring 59 normally maintains the button 30 in an upper position (FIG. 10) in which the tab 61 can sequentially engage each of the notches 74–77 to prevent rotary movement of the actuator knob 25. Thus, with the button 30 in its upward position, control of the conditioner assembly 36 by rotation of the rotary switch 51 is prevented.

Figure 10:
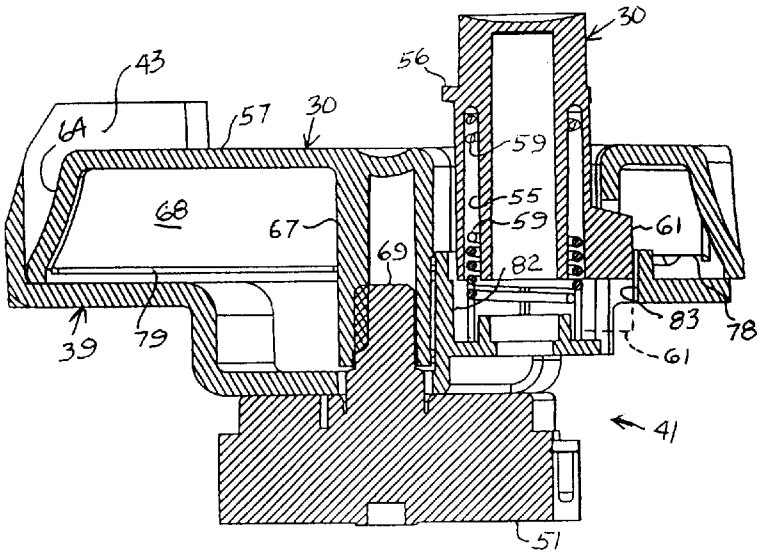
FIG. 10 is a cross-sectional view taken along lines 10—10 of FIG. 8.
Figure 7:
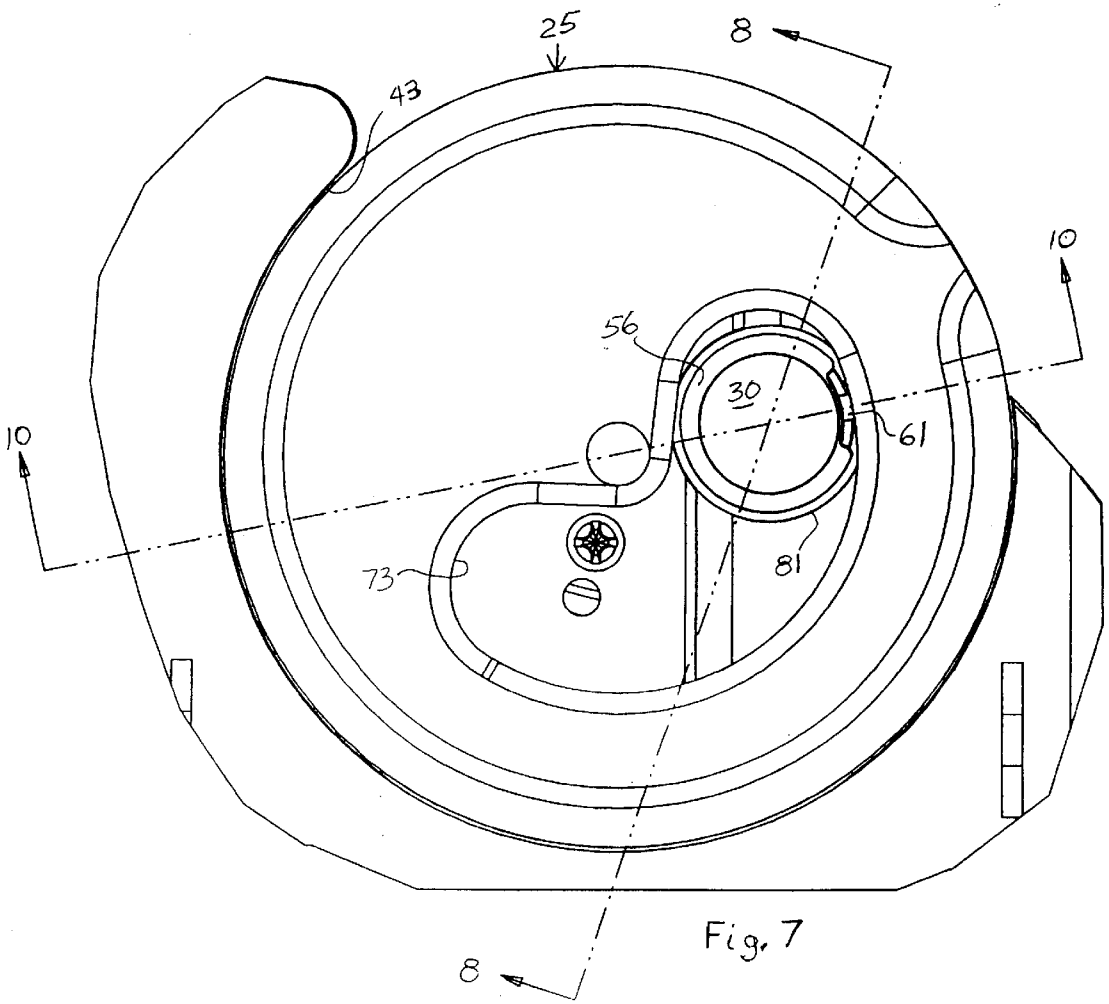
FIG. 7 is a top view of a switch assembly portion of the control assembly shown in FIGS. 5 and 6.

When operation of the heater 11 is desired, the button 30 is depressed rectilinearly against the bias force exerted by the spring member 59 into a lower position within the cylindrical and transverse cavities 82, 83 as shown by dashed lines in FIG. 10. Depression of the button 30 can be accomplished, for example, with a single finger of a user. With the button 30 held in its lower position, the tab 61 thereon is disposed below the bottom edge 78 of the wall portion 71 of the actuator knob 25. Thus, the knob 25 can be rotated by one or more other fingers into a plurality of operating positions in each of which the tab 61 is vertically registered with a different one of the notches 74–77. In each operating position, a release of downward pressure on the push button 30 allows the spring member 59 to move the tab 61 upwardly into one of the registered notches 74–77 and thereby prevent movement out of that position. A desired heater operational mode is, therefore, maintained by locking the switch assembly 41 into a selected position. For example, with the tab 61 engaged in the notch 74, the corresponding rotary position of the switch 51 deenergizes the conditioner assembly 36; with the tab 61 engaged in the notch 75, the corresponding rotary position of the switch 51 energizes only a fan (not shown) to produce ambient air flow through the air flow path 33; with the tab 61 engaged in the notch 76, the corresponding rotary position of the switch 51 provides actuation of the fan and a portion of the heater element 37 to produce a low level flow of heated air through the air flow path 33; and with the tab 61 engaged in the notch 77 the corresponding rotary position of the switch 51 produces energization of the fan and the full heating element 37 to provide a high level of heated air flow through the path 33. Because each such change of operating mode entails the simultaneous application of differently directed forces to the separate and distinct locking button 30 and actuator knob 25 by different body parts, the change requires specific manipulation and dexterity not easily mastered by children. Accordingly, unwanted and possible unsafe operation of the heater 11 by children is prevented.

Obviously, many modifications and variations of the present invention are possible in light of the above teachings. It is to be understood, therefore, that the invention can be practiced otherwise than as specifically described.

What is claimed is:

1. A device for conditioning air comprising:

a housing having an air inlet, an air outlet and an air flow path between the air inlet and the air outlet;

a conditioner assembly disposed in said air flow path and operable to condition air in said air flow path;

an electrical switch connected to said conditioner assembly comprising an actuator adapted for movement between an inactive position and at least one active position; said actuator in said at least one active position causing said conditioner assembly to operate in an active state, and in said inactive position causing said conditioner assembly to be in an inactive state; and a lock comprising a release element adapted for movement between a lock position and an unlock position, wherein in said lock position said release element prevents movement of said actuator from the at least one active position and from the inactive position to other active and inactive positions, and in said unlock position allows movement of said actuator.

2. The device according to claim 1 wherein said actuator moves in one sense and said release element moves in another sense different than said one sense.

3. The device according to claim 2 wherein said one sense is one of rectilinear movement and rotational movement.

4. The device according to claim 3 wherein said one sense is rotational movement and said another sense is linear movement.

5. The device according to claim 1 wherein said actuator is a rotatable knob comprising at least one notch, wherein said release element is a push button assembly comprising a tab; and wherein said tab is latched in said at least one notch in the lock position and said tab is removed from said at least one notch in the unlock position.

6. The device according to claim 5 wherein said housing defines a plurality of outer wall surfaces, said actuator projects from one said outer wall surface, and said release element projects from a different said outer wall surface.

7. The device according to claim 6 wherein said one outer wall surface is a side surface and said different outer wall surface is a top surface.

8. The device according to claim 1 wherein said actuator is adapted for movement into a plurality of active positions and in each of said active positions said electrical switch controls said conditioner assembly to provide a different state of conditioning to air in said air flow path.

9. The device according to claim 8 wherein said housing defines a plurality of outer wall surfaces, said actuator projects from one said outer wall surface and said release element projects from a different said outer wall surface.

10. The device according to claim 9 wherein said one outer wall surface is a side surface and said different outer wall surface is a top surface.

11. The device according to claim 8 wherein said actuator is a rotatable knob comprising a plurality of notches, each associated with a different position of said actuator, wherein said release element is a push button assembly comprising a tab; and wherein said tab is latched in said an associated notch in the lock position, and said tab is removed from said associated notch in the unlock position.

12. The device according to claim 1 wherein said conditioner assembly comprises a blower that induces movement of said air.

13. The device according to claim 12 wherein said conditioner assembly further comprises an electrical heating element that heats said air.

14. A device for conditioning air comprising:

a housing having an air inlet, an air outlet and an air flow path between the air inlet and the air outlet;

a conditioner assembly disposed in said air flow path and operable to condition air in said air flow path;

an actuator movable between first and second positions, wherein said actuator causes said conditioner assembly to be in a first state when said actuator is in said first position and in a second state when said actuator is in said second position; and a lock adapted for locking said actuator, wherein said lock is adapted to lock said actuator in both said first and second positions without requiring manual actuation.

15. The device of claim 14, wherein the lock comprises a push button assembly comprising a tab.

16. The device of claim 15, wherein said actuator is a rotatable knob comprising at least one notch.

17. The device of claim 16, wherein the tab, in a lock position, engages one said notch and prevents rotation of the actuator.

18. The device of claim 17, wherein the locked actuator prevents the conditioner assembly from changing conditioning states.

19. A device for conditioning air comprising:

a housing having an air inlet, an air outlet and an air flow path between the air inlet and the air outlet;

a conditioner assembly disposed in said air flow path and operable to condition air in said air flow path;

an actuator movable between first and second positions, wherein said actuator causes said conditioner assembly to be in a first state when said actuator is in said first position and in a second state when said actuator is in said second position; and a lock adapted for locking said actuator, wherein said lock is at least partially disposed within said actuator.

20. The device of claim 19, wherein the lock comprises a push button assembly comprising a tab.

21. The device of claim 20, wherein said tab fits partially inside an opening in a top surface of said actuator.

22. The device of claim 21, wherein said opening in the top surface of said actuator is an arcuate cavity.

23. The device of claim 22, wherein the center of said arcuate cavity is radially offset from an axis of rotation of the actuator.

24. The device of claim 23, wherein a radial arc of said arcuate cavity defines a range of rotation of said actuator.

25. A device for conditioning air comprising:

a housing having an air inlet, an air outlet and an air flow path between the air inlet and the air outlet;

a conditioner assembly disposed in said air flow path and operable to condition air in said air flow path;

an actuator movable between two positions, wherein said actuator causes said conditioner assembly to be in a first state when said actuator is in said first position and in a second state when said actuator is in said second position; and a lock comprising a release element adapted for movement between a lock position and an unlock position, wherein said lock in the lock position is adapted to lock the actuator at both said two positions so that the actuator cannot be moved from one position to the other position unless the lock is manually actuated.

26. The device of claim 25, wherein the two positions comprise an inactive position and an active position.

27. A device for conditioning air comprising:

a housing having an air inlet, an air outlet and an air flow path between the air inlet and the air outlet;

a conditioner assembly disposed in said air flow path and operable to condition air in said air flow path;

an actuator movable between at least two positions, wherein said actuator in one said position causes said conditioner assembly to be in a first state, and said actuator in another said position causes said conditioner assembly to be in a second state, and wherein said at least two positions of said actuator includes an active position; and a lock comprising a release element adapted for movement between a lock position and an unlock position, wherein said lock is adapted to lock said actuator in an active position and prevents any movement of said actuator to another position when said actuator is locked in the active position.

28. The device of claim 27, wherein said at least two actuator positions comprises at least first and second active positions, and wherein said lock prevents any movement of said actuator between said active positions once said actuator is locked in either of said active positions.

29. The device of claim 28, wherein when the actuator is moved to said first active position said actuator causes said conditioner assembly to activate a fan, and when the actuator is moved to said second active position said actuator causes said conditioner assembly to activate a heater.

30. A device for conditioning air comprising:

a housing having an air inlet, an air outlet and an air flow path between the air inlet and the air outlet;

a conditioner assembly disposed in said air flow path and operable to condition air in said air flow path;

an actuator comprising a rotatable knob having a top surface, an underside, and three notches formed in the underside of said actuator, wherein said actuator is movable between an inactive position and two active positions, each of the inactive position and the two active positions corresponding respectively to one of the three notches in said actuator and one of three different operative states of the conditioner assembly; and a lock comprising a push button and a tab adapted for movement between a lock position and an unlock position, the tab being adapted to engage any one of said three notches in the actuator to lock the actuator in a corresponding position, and adapted to disengage from any one of said three notches upon movement of the push button, the push button being resiliently biased to urge the tab into engagement with any one of said three notches.

* * * * *